US005173708A

United States Patent [19]

Suzuki et al.

[11] Patent Number: 5,173,708

[45] Date of Patent: Dec. 22, 1992

[54] ATTITUDE CONTROL SYSTEM FOR ANTENNA ON MOBILE BODY

[75] Inventors: Katsuo Suzuki, Hekinan; Sadami Mizuno, Chita; Hideharu Kato; Kazuhiko Sekino, both of Toyota; Makoto Morita; Toshimasa Mikawa, both of Susono, all of Japan

[73] Assignee: Aisin Seiki K.K., Kariya City, Japan

[21] Appl. No.: 788,620

[22] Filed: Nov. 6, 1991

[30] Foreign Application Priority Data

Nov. 6, 1990 [JP] Japan ..... 2-300545

[51] Int. Cl.[5] ..... H01Q 3/00

[52] U.S. Cl. ..... 342/359

[58] Field of Search ..... 342/359; 343/765, 766

[56] References Cited

U.S. PATENT DOCUMENTS 4,725,843 2/1988 Suzuki et al. ..... 342/359
4,873,526 10/1989 Katsuo ..... 342/359
5,061,936 10/1991 Suzuki ..... 342/359
5,073,783 12/1991 Uematsu et al. ..... 342/359

*Primary Examiner*—Theodore M. Blum
*Attorney, Agent, or Firm*—Sughrue, Mion, Zinn, Macpeak & Seas

[57] ABSTRACT

An attitude control system for an antenna on a mobile body is comprised of a supporting device for supporting the antenna in such a manner that the antenna is rotatable and is movable in the vertical direction, a driving device for driving the antenna, an attitude change detecting device for detecting a speed of the attitude of the antenna relative to to the source of radio wave, a first control device for controlling the driving device in such a manner that the antenna is driven for cancelling the deviation between the resultant of the attitude change detecting device and a correcting value a receiving device for receiving radio wave which is connected to the antenna, a second control device for changing the attitude of the antenna toward higher receiving level derived from the receiving device and a drift correcting device for renewing the correcting value in such a manner that accumulated vector becomes zero which is the accumulation of a vector upon the changing of the attitude of the antenna.

4 Claims, 16 Drawing Sheets

ATTITUDE CONTROL SYSTEM FOR ANTENNA ON MOBILE BODY

BACKGROUND OF THE INVENTION

The present invention relates to an attitude control system for an antenna on a mobile body, and in particular to an attitude control system for an antenna on a mobile bed which is configurated to track or trace a source of radio wave such as a broadcasting satellite.

In the conventional attitude control system for an antenna on a mobile body such as a vehicle, for orientating the antenna toward a source of radio wave, the conical scan system is used for tracking or tracing the source of radio wave upon the attitude change of the mobile body. In order to enable the precise tracking or tracing of the antenna, a gyro is additionally used as disclosed in U.S. Pat. No. 4,873,526 granted Oct. 10, 1989.

However, the gyro may be subjected to a varying output due to surrounding temperature change, by which it is difficult to ensure the precise tracking or tracing of the antenna.

SUMMARY OF THE INVENTION

It is, therefore, a primary object of the present invention to provide an attitude control for an antenna on a mobile body without the foregoing drawback.

Another object of the present invention is to provide an attitude control for an antenna on a mobile body which is free from the temperature change.

In order to attain the foregoing objects, an attitude control system for an antenna on a mobile body according to the present invention is comprised of supporting means for supporting the antenna in such a manner that the antenna is rotatable and is movable in the vertical direction; driving means for driving the antenna; attitude change detecting means for detecting a speed of the attitude of the antenna relative to to the source of radio wave; first control means for controlling the driving means in such a manner that the antenna is driven for cancelling the deviation between the resultant of the attitude change detecting means and a correcting value; receiving means, connected to the antenna, for receiving radio wave; second control menas for changing the attitude of the antenna toward higher receiving level derived from the receiving means; and drift correcting means for renewing the correcting value in such a manner that accumulated vector becomes zero which is the accumulation of a vector upon the changing of the attitude of the antenna.

The foregoing and other objects, features and advantages of the invention will be apparent from the following more particular description of a preferred embodiment of the invention as illustrated in the accompanying drawings.

DETAILED DESCRIPTION OF THE INVENTION

Before detailing an embodiment of the present invention, it should be noted that a description for each block in each flowchart is described in Appendix attached to this specification.

Figure 1:
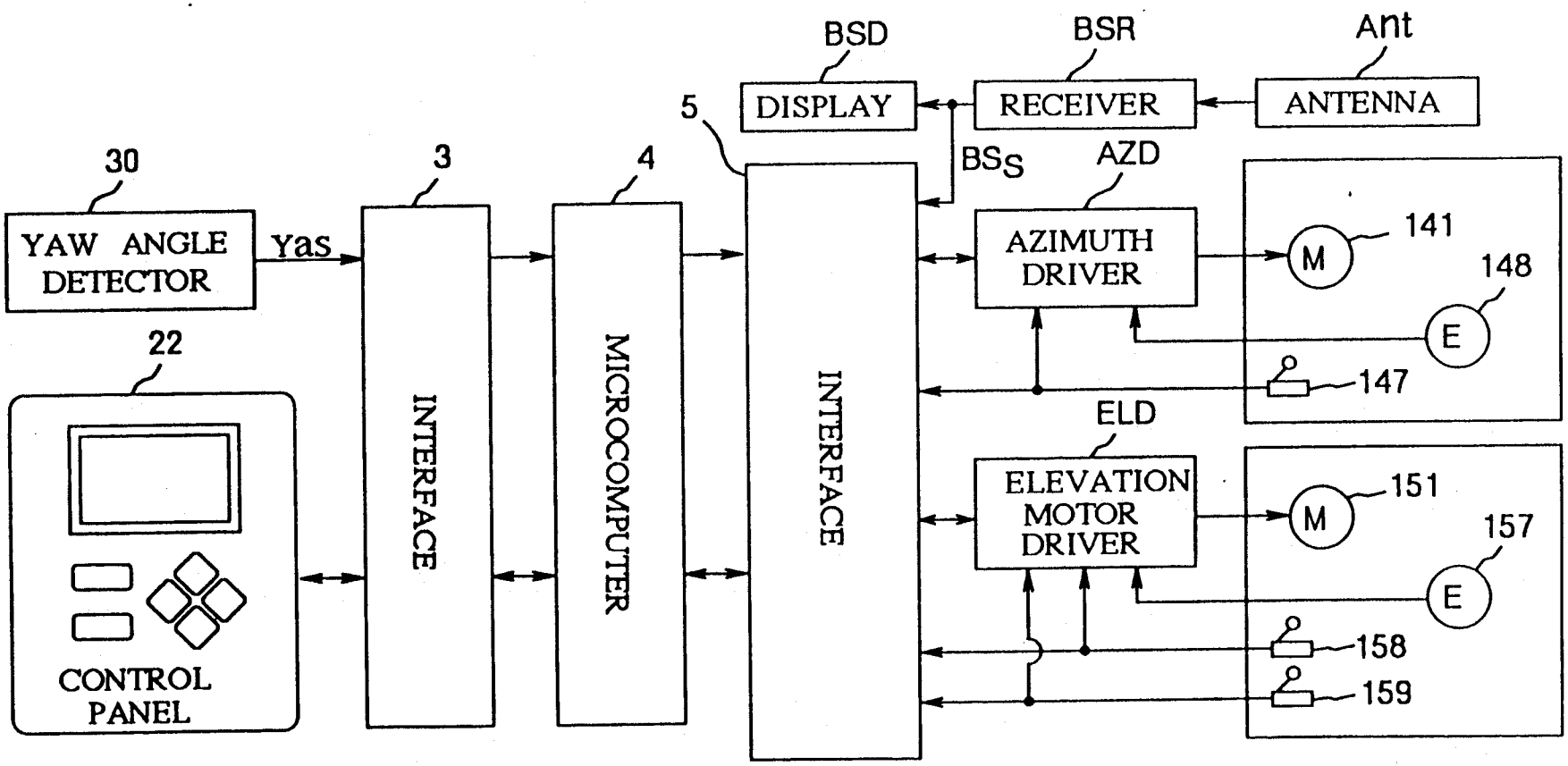
FIG. 1 is a block diagram of an embodiment of an attitude control system for an antenna on a mobile body in accordance with the present invention.
Figure 2A:
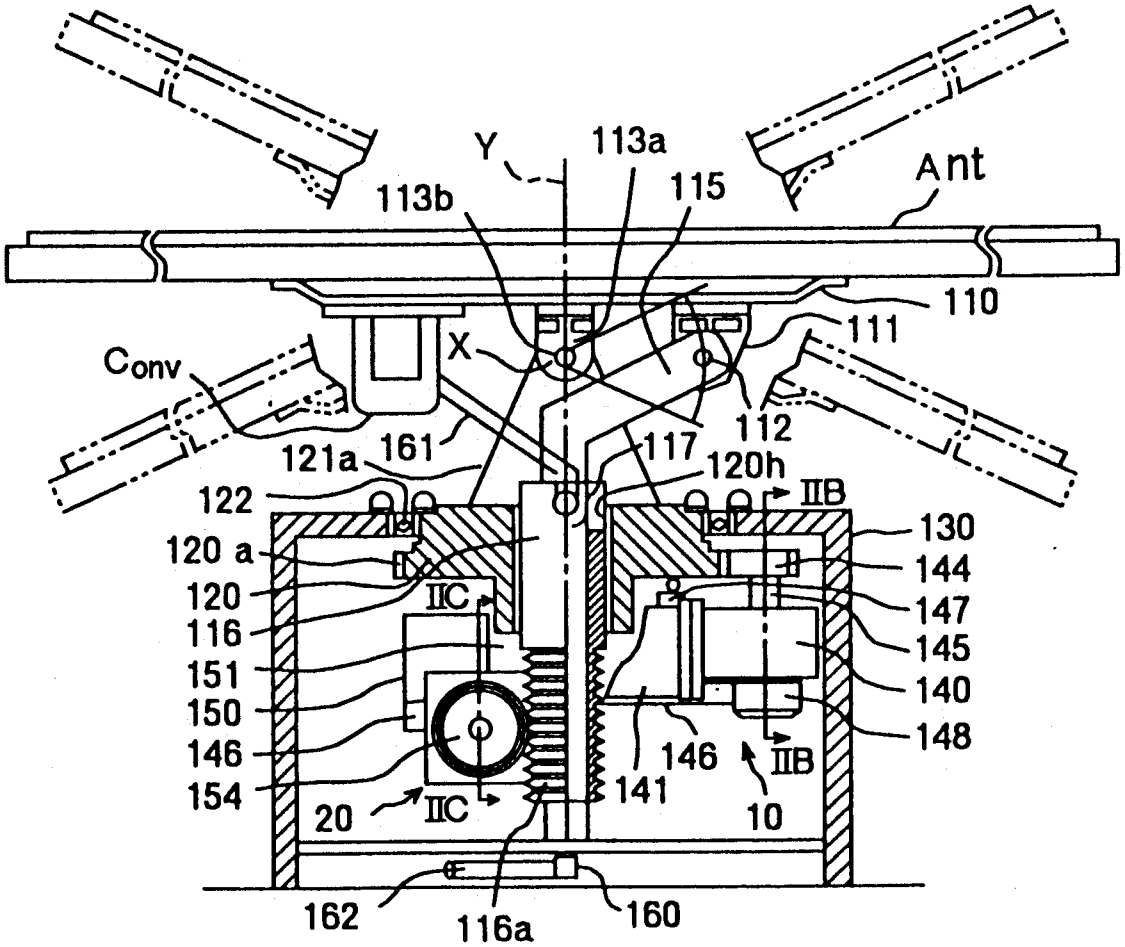
FIG. 2*a* is an elevational cross-sectional view of a mechanism for supporting an antenna.
Figure 2B:
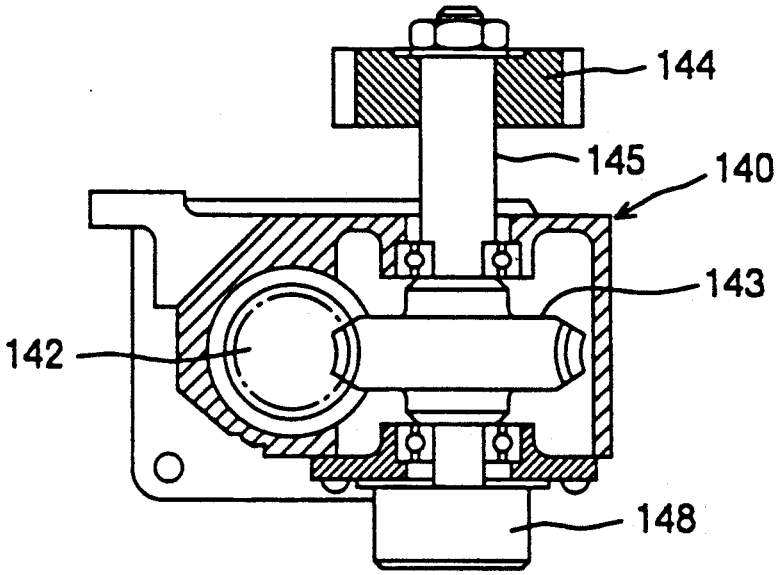
FIG. 2*b* is an enlarged cross-sectional view taken along line IIA—IIA in FIG. 2*a;*
Figure 2C:
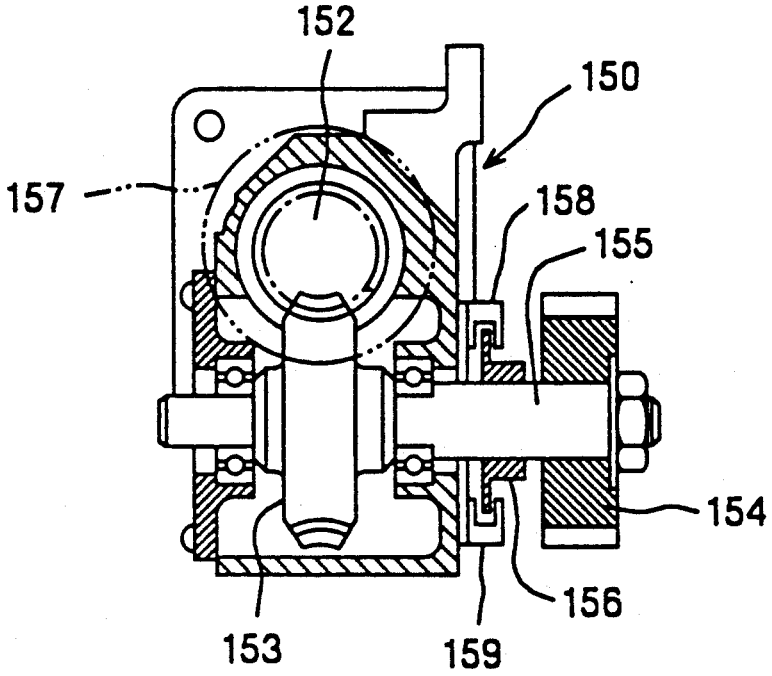
FIG. 2*c* is an enlarged cross-sectional view taken along line IIC—IIC in FIG. 2*a;*
Figure 2D:
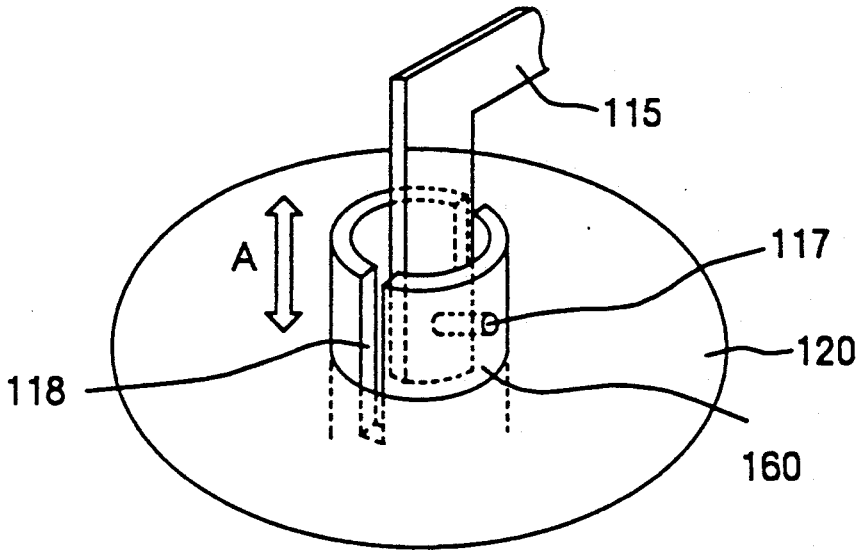
FIG. 2*d* is a plane view of a rotating member.
Figure 2E:
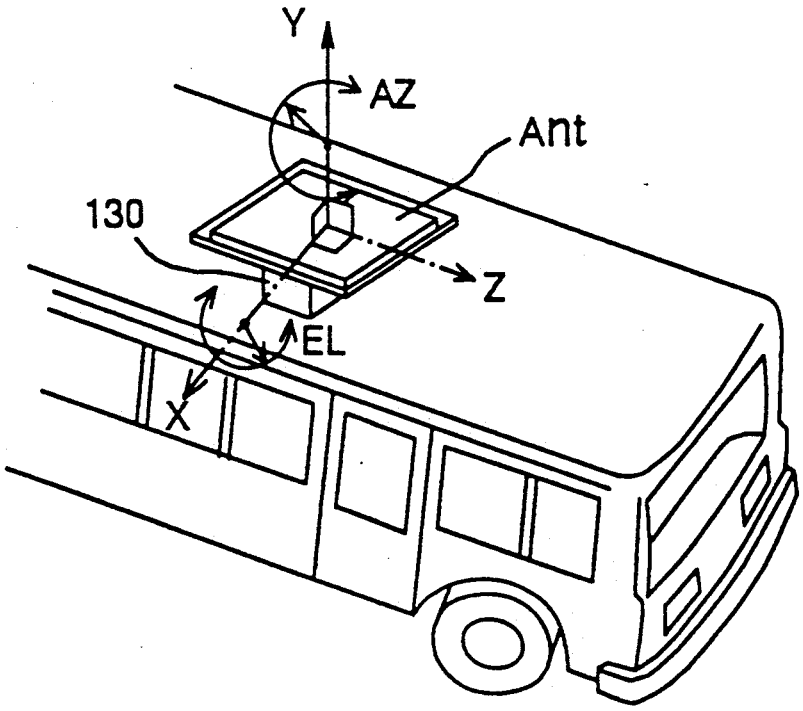
FIG. 2*e* is a perspective view of an antenna mounted on a vehicle.

Referring now to FIG. 1, there is illustrated a block diagram of a control device which is to be mounted on a vehicle shown in FIG. 2*e* in order to control the attitude of a BS antenna Ant for receiving radio wave from a broadcasting satellite. On the vehicle, a yaw angle detector 30 is provided which is in the form of a gyro is mounted in order to detect a yaw angle speed of the vehicle and the resultant yaw angle is set to be fed to an interface 3 as a yaw angle speed signal in the form of an analogue signal In the interface 3, processes are set to be established such as noise deletion, amplification and other required treatments to the fed yaw angle speed signal and the resultant yaw angle signal will be supplied to a microcomputer 4 which includes a CPU, RAMs, ROMs and related electric circuits The microcomputer 4 is set to read yaw angle signal with converting it in to a digital signal.

The microcomputer 4 is connected with an interface 3 with an operation board 22 and an interface 5 to which a BS receiver BSR, an azimuth driver AZD and an elevation motor driver ELD are connected.

Radio wave caught by the BS antenna Ant is demodulated in the BS receiver BSR and the resultant radio wave is set to be displayed on a display BSD. Radio wave is also fed to the interface 5 and is converted into an analogue signal for representing its signal level which is to be fed to the microcomputer 4. The microcomputer 4 reads this signal with converting it into a digital signal.

Each of the azimuth motor diver AZD and the elevation motor driver ELD has a controller or computer circuit which includes a CPU and a motor driver or an electric circuit for driving a respective motor in either direction, and is set to rotate the motor through an angle in a direction in response to a stepwise rotation signal from the microcomputer 4. Each of the azimuth motor diver AZD and the elevation motor driver ELD is so constructed as to drive the respective motor at a speed in a direction in response to a continuous signal from the microcomputer 4. Electric pulses generated in each of a rotary encoder 148 in the azimuth mechanism and a rotary encoder of the elevation mechanism are set to be counted for knowing the change of the attitude of the antenna Ant, and data for indicating current azimuth position and elevation position thereof are held in an azimuth position register AZPR and an elevation position register ELPR, respectively.

FIG. 2*a* illustrates a mechanism for supporting the BS antenna Ant in its required position. This mechanism is so constructed as to rotate the BS antenna Ant in the azimuth direction about a first axis Y and the elevation direction about a second axis X.

The BS antenna Ant is a beam antenna for receiving radio wave in a relatively wide range which is formed into an annular plate, and is secured to a bracket 110.

Figure 3:
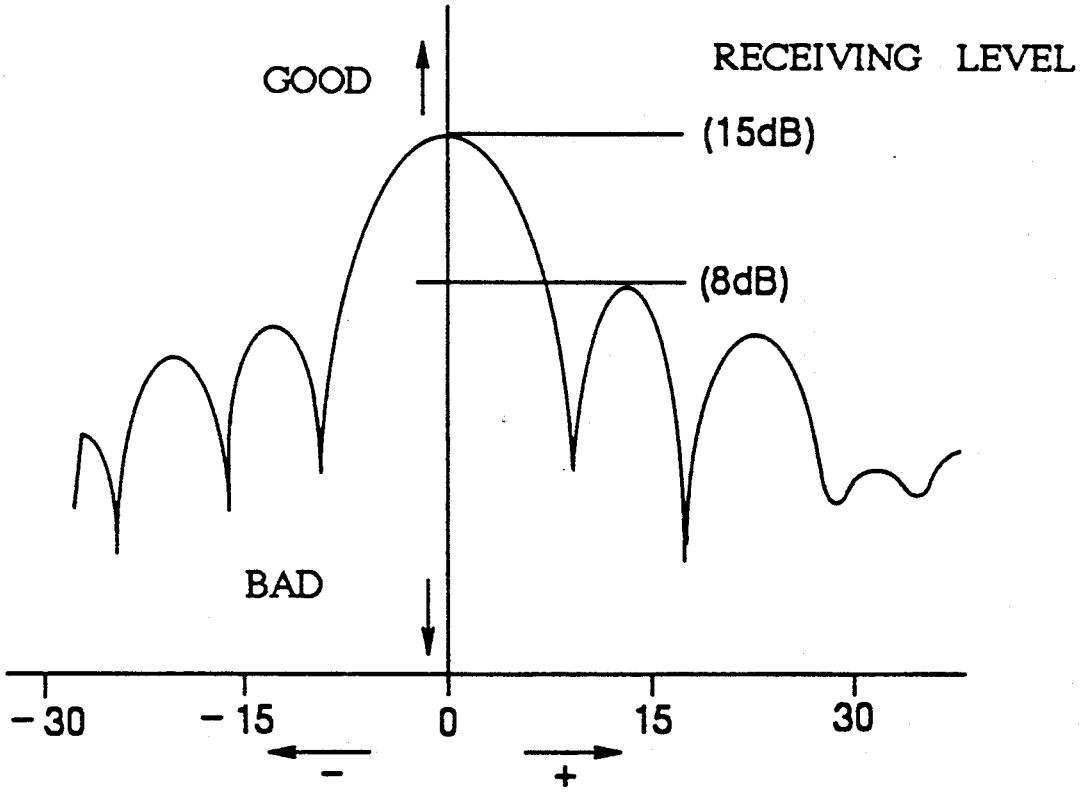
FIG. 3 is a graph showing the radio wave receiving characteristic of an antenna.

FIG. 3 shows a graph which indicates a directivity of the BS antenna Ant. The vertical axis shows the receiving level and the horizontal axis shows an angle between a line passing through a center portion at a right angle of a receiving surface of the antenna Ant and a line connecting the center portion and a stationary satellite as a source of radio wave. When this angle is less than 8 degrees, more than 50% of the maximum receiving level (15 db) can be obtained.

Referring back to FIG. 2*a*, a horizontal shaft 113*b* whose center is defined as the second axis X is secured to an angle 113*a* of the bracket 110. The horizontal shaft 113*b* is set to extend in a direction perpendicular to the paper and is connected at its one end to a supporting arm 121*a* rotatably via a bearing (not shown). The supporting arm 121*a* is secured to a rotating member 120. The other end of the horizontal shaft 113*b* is rotatably connected via a bearing (not shown) to another supporting arm which is similar to the supporting arm 121*a*. Another supporting arm is secured to the rotating member 120 symmetrically to the supporting arm 121*a* with respect to a cylindrical shaft 116.

The rotating member 120 is substantially in the form of an annular pinion having at its central and side portions a guide hole 120*h* and a gear 120*a*, respectively, and is connected via a bearing 122 to a fixed body 130 so as to be rotatable about the first axis Y or a rotating center of the gear 120*a*.

The gear 120*a* of the rotating member 120 is in mesh engagement with a gear 144 which is set to be driven by an azimuth drive motor 141 via a gear shaft 145 and a reducer 140 which are fixedly mounted to a supporting member on the fixed body 130. The gear shaft 145 is provided with the rotary encoder 148 for generating an electric pulse each time the gear shaft 145 rotates a set angle which is to be fed to the azimuth motor driver AZD.

In opposition to a lower surface of the rotating member 120, there is provided a switch 147 for detecting an azimuth home position. In the lower surface of the rotating member 120, there is formed a single tapered hole for receiving an operating lever or member of the switch 147. Normally, the operating lever of the switch 147 is in abutment with the lower surface of the rotating member 120, the switch 147 is being kept at its off or opened condition. However, as soon as the operating lever is dropped in the tapered hole, the switch 147 is brought into its on or closed condition showing the azimuth home position. During one rotation of the rotating member 120, the operating lever of the switch 147 is set to be brought into engagement with the tapered hole once. The opening-closing signal of the switch 147 is set to be fed to the azimuth motor driver AZD and the microcomputer 4 via the interface 5.

Referring to FIG. 2*b* which shows an enlarged cross-sectional view taken along line IIB—IIB in FIG. 2*a*, within the reducer 140, a worm-wheel 143 is fixedly mounted on the gear shaft 145 and a worm 142 which is in mesh engagement with the worm-wheel 143 is fixedly mounted on a rotating shaft of the motor 141 (shown in FIG. 2*a*).

When the motor 141 is rotated in the normal direction, the gear 144 is also rotated in the same direction, thereby establishing a rotation of the rotating member 120 in the normal direction about the first axis Y. That is to say, the antenna Ant is rotated in the normal direction about the first axis Y. Contrary to this, if the motor 141 is rotated in the reverse direction, the antenna Ant is also rotated in the reverse direction.

Referring again back to FIG. 2*a*, the cylindrical shaft 116 is passed through the guide hole 120*h* of the rotating member 120, thereby permitting the axial movement of the cylindrical shaft 116 along the first axis Y relative to the rotating member 120 without being rotated relative thereto. A spline connection between the cylindrical shaft 116 and the rotating member 120, though it is not shown in FIG. 2*a*, enables such movement of the cylindrical shaft 116. Thus, the rotation of the rotating member 120 about the first axis Y brings the rotation of the cylindrical shaft 116 about the first axis Y in the same direction.

A pin 117 is fixedly driven to an upper end portion of the cylindrical shaft 116, and is connected rotably to a lower portion of a link arm 115 whose upper portion is connected to a pin 112 rotatably which is secured to an angle 111 of an bracket 110.

Since the bracket 110 is spaced from the angle 113*a* in the direction of the extension of the horizontal shaft 113*b* which corresponding to a direction perpendicular to a paper showing FIG. 2*a*, in FIG. 2*a*, the upward movement of the cylindrical shaft 116 brings the counterclockwise or upward rotation of the antenna Ant about the horizontal shaft 113*b*, and the downward movement of the cylindrical shaft 116 brings the clockwise or downward rotation of the antenna Ant.

A plurality of ring shaped gears 116*a* are provided on a lower half portion of the cylindrical shaft 116 and each of the gear 116*a* is in parallel with a direction which is perpendicular to the first axis Y. A gear 154 is im mesh engagement with any one of the ring shaped gears 116*a*.

Referring to FIG. 2*c* which shows an enlarged cross-sectional view taken along line IIC—IIC in FIG. 1, a gear shaft 155 to which the gear 154 is secured is connected with a worm wheel 153 of the reducer 150. A worm 152 which is in mesh engagement with the worm-wheel 153 is fixedly mounted on a rotating shaft of the elevation drive motor 151 shown in FIG. 2*a*. The reducer 150 and the motor 151 are fixedly mounted on a supporting member 146 secured to the fixing member 130.

When the elevation drive motor 151 is turned in the normal direction, the gear 154 is rotated in the clockwise direction in FIG. 2*a*, which leads the downward movement of the cylindrical shaft 116 resulting in the clockwise or upward rotation of the antenna Ant. The turning-on of the elevation drive motor 151 in the reverse direction brings the counterclockwise or downward rotation of the antenna Ant.

Due to the vertical movement of the cylindrical shaft 116, a rotational force is transmitted from the pin 117 to the link arm 115, thereby rotating the link arm 115 about the pin 117. For enabling this rotation, the upper end of the cylindrical shaft 116 is provided with a pair of opposed grooves or slits 118 as shown in FIG. 2*d*. It is noted that the cylindrical shaft 116 is not prevented from being rotated by the gear 154 which is in rotating or stationary condition and is bale to rotate about the first axis Y without being moved in the vertical direction or relative to the gear 154.

Referring again to FIG. 2*c*, a cam plate 156 is secured to the gear shaft 155 of the gear 154, and is formed into a stepped configuration having large diameter portions and a small diameter portion therebetween in the circumferential direction. With respect to the cam plate 156, there are an upper limit switch 158 and a lower limit switch 159 are located in the opposed manner. While the elevation rotating angle of the antenna Ant is within a range, an operating lever of the upper limit switch 158 and an operating lever of the lower limit switch 159 are away from an outer surface of the cam plate 156, thereby keeping the off or opened conditions of the switches 158 and 159.

As a result of the clockwise rotation of the antenna Ant through an angle, a tapered portion between the large diameter and small diameter portions of the cam plate 156 is brought into engagement with the operating lever of the switch 158, thereby turning on the switch 158. On the other hand, in the case of the counterclockwise rotation of the antenna Ant through an angle, another tapered between another large diameter and small diameter portions of the cam plate 156 is brought into engagement with the operating lever of the switch 159, thereby turning on the switch 159. The conditions of the switches 158 and 159 are fed as electric signals to both of the elevation driver ELD and the microcomputer 4 via the interface 5.

The rotary encoder 157 is coupled to the worm 152 which is set to generate an electric pulse every time the worm 152 rotates an angle. This pulse is fed to the elevation driver ELD.

As mentioned above, the reducer 140 for rotating the antenna Ant about the first axis Y, the motor 141, the reducer 150 for rotating the antenna Ant about the second axis Y or the horizontal shaft 113*b* and the motor 151 are mounted on the common fixed member 130, thereby not requiring frictional connecting means for the current applications to the motors 141 and 151.

Referring to FIG. 2*a*, a converter Conv secured to the bracket 110 is used for converting radio wave of 12 GHz band from satellite into BS-IF of 1 GHz band. The resultant signal is fed, via a cable 161 and a rotary joint 16, to the BS receiver BSR shown in FIG. 1.

However, since the converter Conv is set to be rotated together with the antenna Ant about the first axis Y and/or the second axis X, an input line and an output line of the converter Conv should be connected to an input line and an output line of the BS receiver BSR, respectively, on the fixed member via frictional connecting means.

For this reason, an electric cable means 161 including the input and output lines of the converter Conv is made into a relatively flexible so as to enable a rotation of the antenna Ant about the horizontal shaft 113*b* through an angle more than 360 degrees. The electric cable means 161 is connected to the rotary joint 160 after passing through the cylindrical shaft 160. The rotary joint 160 is connected with an electric cable means 162 of the BS receiver BSR, thereby establishing the electric connection between the cables means 161 and 162 regardless of the rotation of the cylindrical shaft 116. The cable means 161 is brought into a swing movement about a portion near the pin 117 in response to the rotation of the antenna Ant about the horizontal shaft 113*b*. Thus, in this embodiment, only one frictional connecting means or the rotary joint 160 is used.

The driving gear 154 which is driven by the elevation drive motor 151 is set to bring the cylindrical shaft 116 into the reciprocal movement 116 which is in sliding passed through the rotating member 120. Thus, the rotating member 120 and the components 144, 140 and 141 serving for driving the rotating member 120 are not driven by the elevation drive motor 151 so that no load is supplied thereto. The components to be supported by the elevation drive motor 15 are, in effect, the antenna Ant, the converter Conv, the link arm 115 and the cylindrical shaft 116 which are not so large load or small inertia in total, which enables the precise and high speed operation of the antenna Ant in its azimuth and elevation movements.

Figure 4:
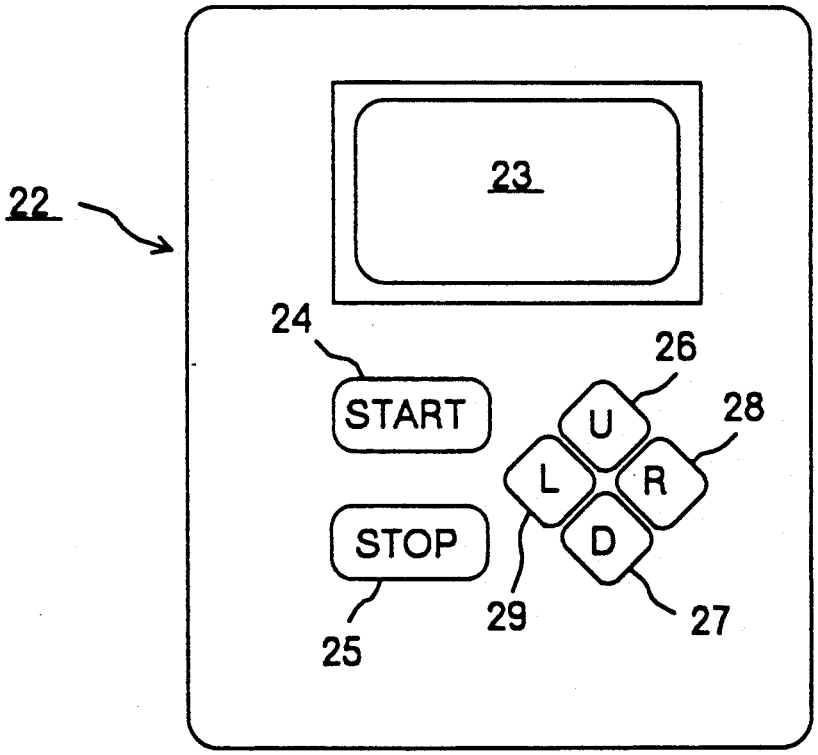
FIG. 4 is an enlarged plane view of a operation board.

Referring to FIG. 4, the operation board 22 includes an LCD 23 for indicating thereon azimuth data of the antenna Ant, elevation or dip data of the antenna Ant, the receiving level of the antenna Ant and messages, a "START" key 24 for starting the automatical control of the attitude of the antenna Ant, a "STOP" key 25 for stopping the automatical control of the attitude of the antenna Ant, a "U" key 24 for raising the antenna Ant in the manual control of the attitude of the antenna Ant, a "D" key 27 for lowering the antenna Ant in the manual control of the attitude of the antenna Ant, an "R" key 28 for moving the antenna Ant rightwardly in the manual control of the attitude of the antenna Ant and a "L" key for moving the antenna Ant leftwardly in the manual control of the attitude of the antenna Ant.

Figure 5:
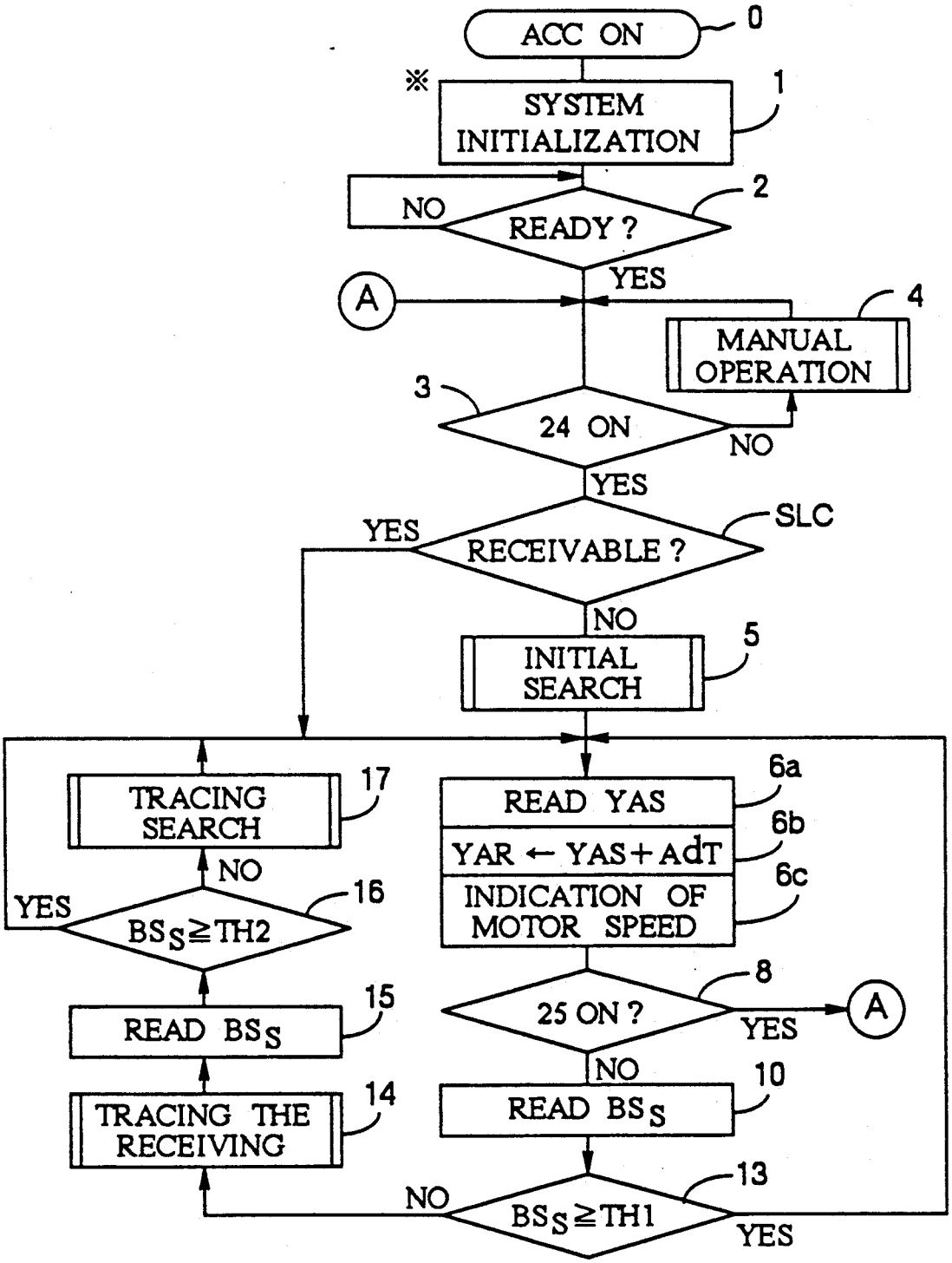
FIG. 5 is a flowchart showing a main routine of a microcomputer.

In FIG. 5, there is illustrated a flowchart which shows an outlined or a brief control operation of the microcomputer 4. While an ignition key (not shown) is being turned on or "Acc" is in on condition under which an engine (not shown) is running, a power supply circuit (not shown) is connected to an on-vehicle battery (not shown) and an electric current is supplied to each of the electric circuits shown in FIG. 1. It is noted that each of the motor drivers AZD and ELD is supplied with another current from the on-vehicle battery or another battery means (not shown).

Immediately upon supply of the current to the microcomputer 4 per se, at step 1, a system initialization is performed, thereby setting an initial value in each of registers, timers and counter and other components and a negative signal at an output port. During this initialization, an initialization of the attitude of the antenna Ant is established in such a manner that the switch 147 is turned on for locating the antenna Ant at its home position in the azimuth direction, the switch 159 is turned on for locating the antenna Ant at its original position in the elevation direction, and corresponding registers AZPR and ELPR are cleared.

The microcomputer 4, upon receipt of Ready signals from both of the motor drivers AZD and Eld (step 2), performs a manual operation procedure until the "START" key 24 is turned on at step 3.

Figure 6:
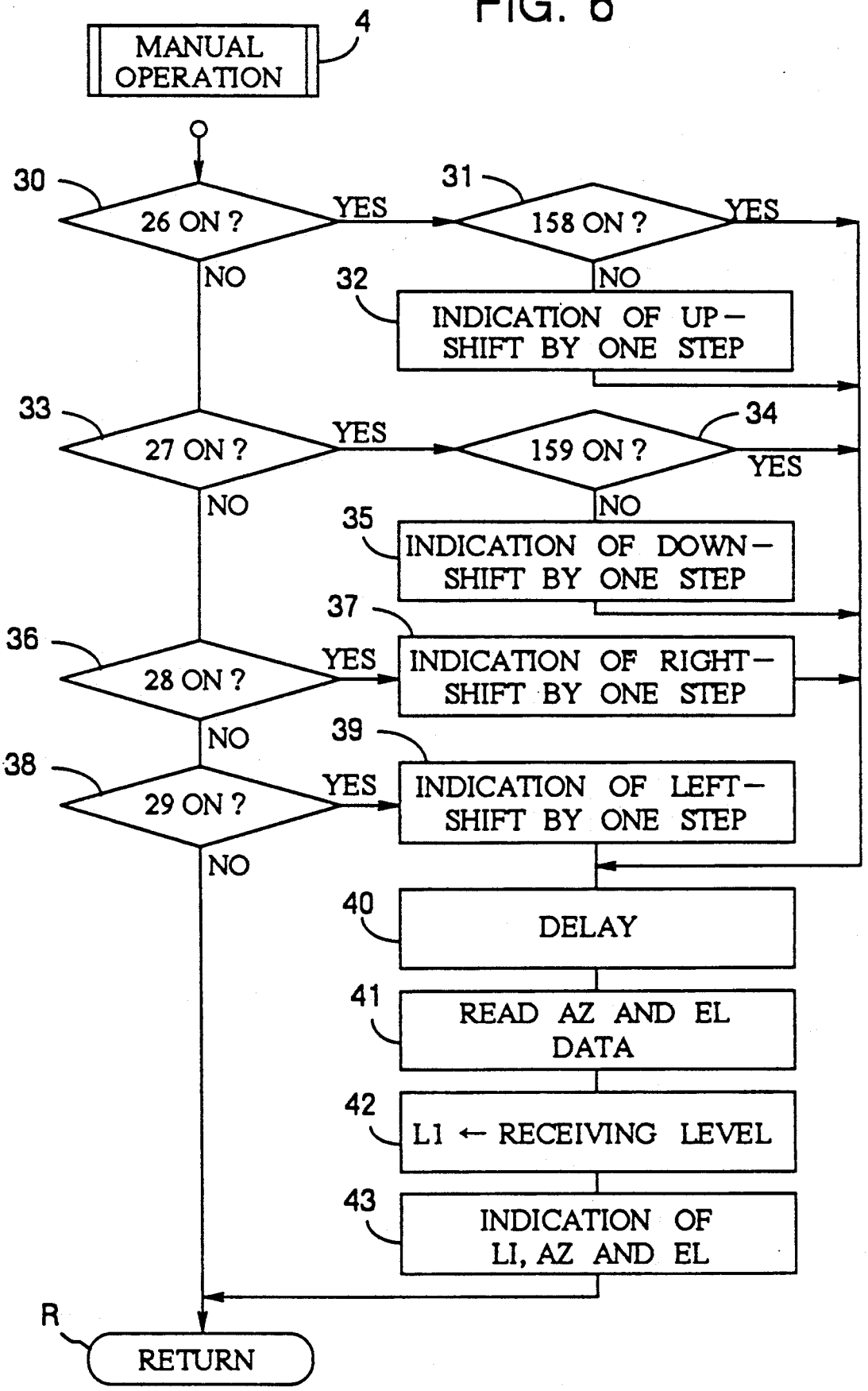
FIG. 6 is a flowchart showing a procedure of a subroutine for the manual operation.

The manual operation procedure will be hereinafter with reference to FIG. 6. Upon turning-on of the "U" key 26 at step 30, the control proceeds to step 31 for checking whether the switch 158 is turned on or not. If so , the antenna Ant is found to be in its upper dip limit in the elevation direction and further movement of the antenna Ant is found to be impossible in the upward direction. Otherwise, the driver ELD is ordered to move the antenna Ant by one step in the upward direction (step 32). Also, when the "D" key 27 is turned on (step 33), at step 33, the switch 159 is checked. If the switch is in on or closed condition, the antenna Ant is found to be in its lower dip limit in the elevation direction and further movement of the antenna Ant is found to be impossible in the downward direction. Otherwise, at step 35, the driver ELD is ordered to to move the antenna Ant by one step in the downward direction.

In the case of the closure of the "R" key 28, the microcomputer 4 proceeds its control from step 36 to step 37 for ordering one step shift in the rightward direction or clockwise direction of the antenna Ant to the driver AZD, and In the case of the closure of the "L" key 29, the microcomputer 4 proceeds its control from step 38 to step 39 for ordering one step shift in the leftward direction or counterclockwise direction of the antenna Ant to the driver AZD.

The microcomputer 4 is, at step 40, set to wait the supply of any one of the commands for moving or shifting the antenna Ant in the upward, downward, rightward and leftward directions by one step, and read data Az and EL from the driver AZD and ELD, respectively at step 41. Furthermore, the receiving level BSs is stored into a resister L1 at step 42, and data Az and EL and the receiving level BSs are displayed on the LCD 23.

Figure 7:
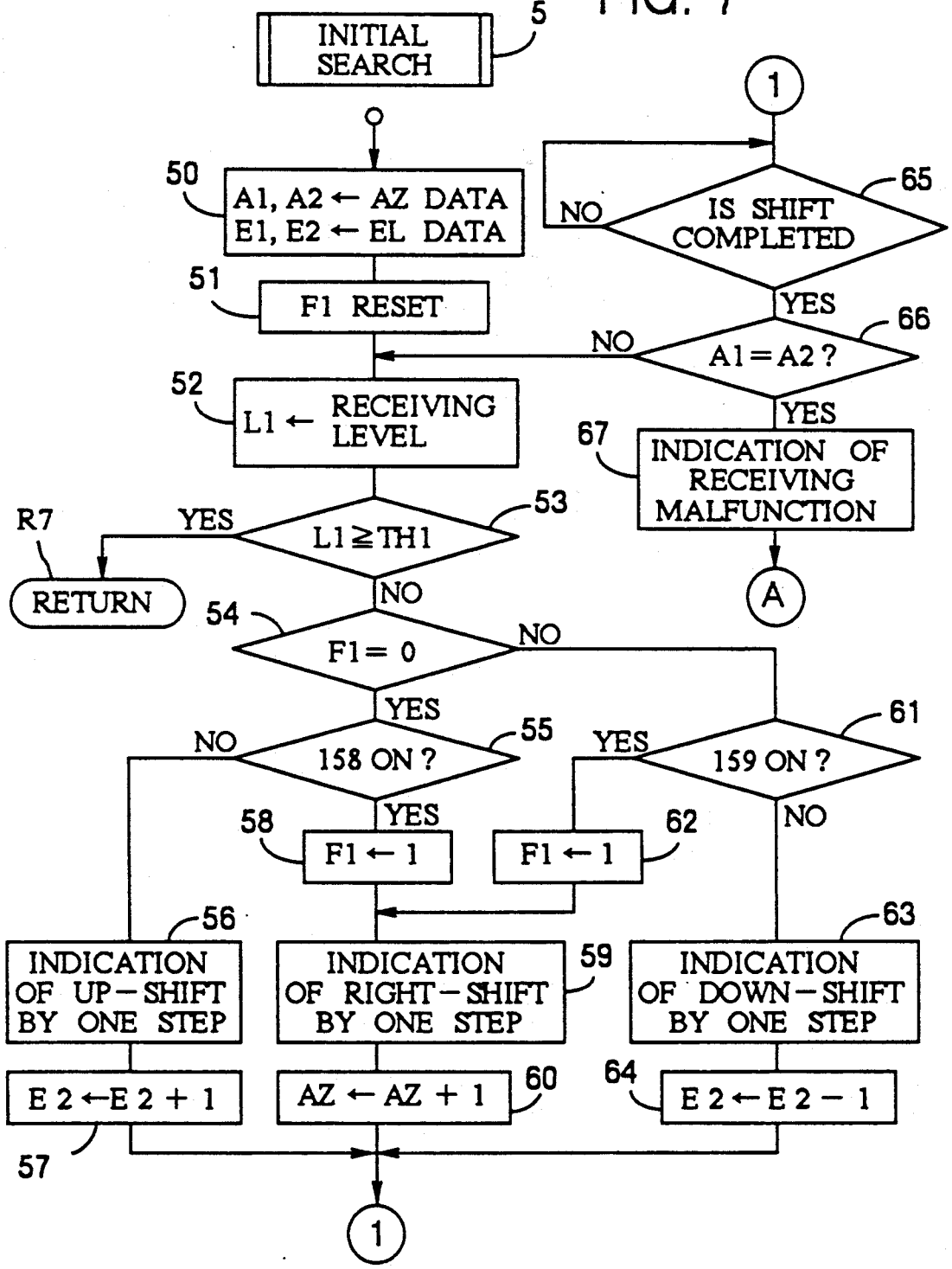
FIG. 7 is a flowchart showing a procedure of a subroutine for the initial search.

The microcomputer 4 is set to perform "Initial Search" which is detailed in FIG. 7 at step S5 when the "START" key 24 is turned on at steps 4 and 5 (FIG. 5).

Figure 10:
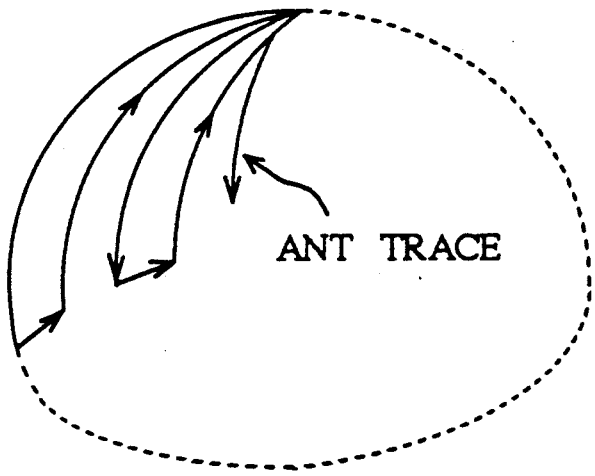
FIG. 10 shows a movement of an antenna schematically.

Before explaining the contents of "Initial Search" with reference to FIG. 7, the basic or brief concept of "Initial Search" will be described hereinbelow, with reference to FIG. 10. In "Initial Search", with monitoring the receiving level, the attitude of the antenna Ant in the elevation direction is changed step by step or one by one from the lower limit or the dip limit to the upper limit or the wave angle limit, and as soon as the antenna Ant reaches the upper limit the antenna Ant is shifted by one step rightwardly in the azimuth direction. Thereafter, the antenna Ant is transferred downwardly in the elevation direction step by step or one by one from the upper limit to the lower limit, and as soon as the antenna Ant reaches the lower limit the antenna Ant is shifted by one step rightwardly in the azimuth direction. The foregoing movement is set to be repeated until the receiving level BsS becomes a sufficient value for the receiving or the completion of one rotation of the antenna Ant in the azimuth direction during which the antenna Ant is set to be moved from the lower limit to the upper limit and vice versa. The trace of the antenna Ant is schematically illustrated in FIG. 10.

Referring to FIG. 7 for detailing the "Initial Search", at step 50, the current data Az is stored in registers A1 and A2 and the current EL data is stored in registers E1 and E2, and at step 51 a flag F1 is reset which is used for indicating the upward or the downward in the elevation direction.

Thereafter, the receiving level BSs is read at step 52. When the resultant receiving level BSs or the value in the resister L1 is more than or equal to a set level TH1, the microcomputer 4 begins immediately or at once to return the control to the main routine. If the receiving level BSs is less than the set value TH1, the microcomputer 4 begins to change the attitude of the antenna Ant at step 54 and subsequent steps thereto. In this attitude changing of the antenna Ant, under the reset (0) condition of the flag F1, except for the closure of the switch 158, steps 54 and 55 are executed, and at step 56 the elevation motor driver ELD is ordered to establish one step upward movement of the antenna Ant as described above At step S57, the value of in the resister E2 is added with 1. Upon receipt of the signal indicating the completion of the shifting from the driver ELD, the microcomputer 4 returns the control to step 52 and continues to repeat the foregoing operations with monitoring the receiving level BSs. When the switch 158 is turned on before the receiving level BSs becomes more than or equal to the set value TH1, the flag F1 is set (1) at step 58, the driver AZD is ordered to establish a rightward shift by one step in the azimuth direction at step 59, and the value in the register A2 is added with 1.

After the setting Of the flag F1, steps 54 and 61 are executed, the driver ELD is set to establish a downward shift by one step in the elevation direction at step 63, and the value in the resister E2 is subtracted with 1. When the switch 159 is turned on during the foregoing repetition, the flag F1 is reset at step 62, the rightward shift by one step in the azimuth direction is ordered to the driver AZD, and the value in the resister A2 is added with 1.

When the receiving level BSs becomes more than or equal to the set value TH1 during the repetition, the control is returned to the main routine (FIG. 5). If the attitude of the antenna Ant becomes a condition under the initiation of the "INITIAL SEARCH" before the receiving level BSs becomes more than or equal to the set value TH1 or the values in the registers A2 and E2 become equal to the values in the registers A1 and E1, respectively, steps 66 and 67 are executed, the LCD 23 displays to the effect that the receiving is in malfunction, and the control is returned to the main routine (FIG. 5).

Referring back to FIG. 5, during the execution of the "INITIAL SEARCH", when an attitude of the antenna Ant is determined or found at which the receiving level is more than or equal to the set value TH1, at step **S6*a* in FIG. 5, the yaw angle speed Yas is read detected by the yaw angle speed detector 30, and the resultant yaw angle speed Yas is added with a value AJT in a drift correction value resister AJTR, a value YAR which is the summation of Yas and AJt is stored in a speed resister YARR at step 6*b*. The value YAR is fed to the driver AZD at step 6*c***. It should be noted that the sign of the value YAR indicates the direction of the motor rotation and the absolute value of the YAR indicates the speed.

The azimuth motor driver AZD is set to drive the azimuth motor 141 for moving or rotating the antenna Ant in the rightward (leftward) direction when the sign of the value YAR is minus (plus) or the vehicle's turning direction is the leftward (rightward) direction at a speed which is determined by a rotational speed of the antenna Ant calculated by the pulses from the rotary encoder 148 and the absolute value of the value YAR.

After the feeding of the value YAR to the driver AZD at step **6*c*, the microcomputer 4 begins to start a timer (not shown). Due to the repetition executions of steps 6*c*, 14, 17 and so on at a cycle of T1 substantially, the control return to step 6*a* from any one of steps 13, 16 and 17** is established after a time-over of the timer.

The microcomputer 4 reads the receiving level BSs and stores the same in the register L1 at step 10. The data Az and EL indicating the attitude of the antenna Ant are read from the drivers AZD and ELD, respectively and are displayed on the LCD 23.

(I) Attitude control procedure

This procedure is established based on the yaw angle speed Yas detected by the yaw angle speed detector 30 in such a manner that steps 6*a*, 6*b*, 6*c*, 8, 10, 13 and 6*a* are executed repeatedly so long as the receiving level BSs or the value in the register L1 is more than or equal to the set value TH1.

That is to say, while the the receiving level BSs or the value in the register L1 is more than or equal to the set value TH1, if the yaw angle speed Yas is changed by a quantity, the attitude of the antenna Ant is set to be corrected in correspondence with the changed quantity. While such procedure is being continued, if the "STOP" key 25 is closed, this is detected at step 8, the control proceeds to step 3 and becomes in the waiting condition.

During the executions of 6*a*, 6*b*, 6*c*, 8, 10, 13 and 6*a* in a looped manner, if the receiving level BSs or the value in the resister L1 becomes less than the set value TH1, this is detected at step 16 and "TRACING FOR RECEIVING" is executed at step 17. Upon completion of this Procedure or subroutine, the receiving level BSs is read at step 15 and is compared with another set value TH2 which is lower than the set value TH1. If the receiving level BSs is less than the set value TH2, the control proceeds to step 17 for executing "TRACING SEARCH".

(II) "TRACING SEARCH" will be described in detail with reference to FIGS. 8*a*, 8*b*, 8*c* and 11.

Figure 11:
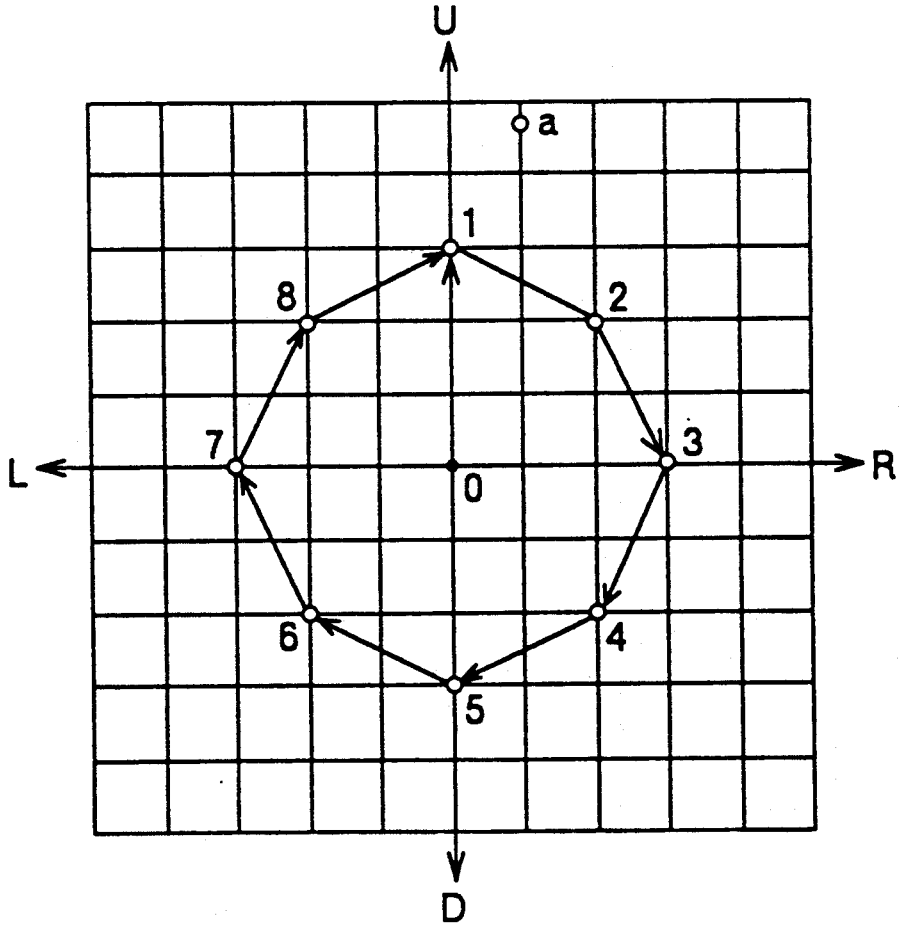
FIG. 11 is a graph showing the changing quantity of an antenna under tracking for receiving.

First of all, referring to FIG. 11 as a conceptual plane view showing the scanning position of the antenna Ant which is in the conical scan within a minute range. This conical scan within a minute range is based on the phenomena that the maximum value of the receiving level is appeared as a result of its variation when the target source of radio wave is offset from the center point of the beam of the antenna Ant, contrary to the fact that the coincidence of the target source of radio wave with the center point of the beam of the antenna Ant holds the receiving level at a constant. In FIG. 11, each section of the matrix shows one step (1 degrees) in the elevation direction and one step (1 degrees) of the azimuth direction. Each point 1, 2, 3, 4, 5, 6, 7 and 8 is a projecting point of the main beam of the antenna Ant, a point 0 is the rotation center point of the main beam of the antenna Ant, and an arrow shows the direction to which the antenna Ant is oriented. It is assumed that an isotrophy source of ratio wave at a point "a".

(1) The antenna Ant is driven from the original or starting point 0 to the point 1 (steps 70 through 73), the receiving level at the point 1 is stored at step 84, 2 step rightward shift in azimuth direction and 1 step downward shift in the elevation direction are established ±or the orientation towards the point 2 at step 74, and the receiving level at the point 2 is stored at step 84.

(2) Next, 1 step rightward shift in azimuth direction and 2 step downward shift in the elevation direction are established for the orientation towards the point 3 at step 75, and the receiving level at the point 3 is stored at step 84.

(3) Next, 1 step leftward shift in azimuth direction and 2 step downward shift in the elevation direction are established for the orientation towards the point 4 at step 76, and the receiving level at the point 4 is stored at step 84.

(4) Next, 2 step leftward shift in azimuth direction and 1 step downward shift in the elevation direction are established for the orientation towards the point 5 at step 77, and the receiving level at the point 5 is stored at step 84.

(5) Next, 2 step leftward shift in azimuth direction and 1 step upward shift in the elevation direction are established for the orientation towards the point 6 at step 78, and the receiving level at the point 6 is stored at step 84.

(6) Next, 1 step leftward shift in azimuth direction and 2 step upward shift in the elevation direction are established for the orientation towards the point 7 at step 79, and the receiving level at the point 7 is stored at step 84.

(7) Next, 1 step rightward shift in azimuth direction and 2 step upward shift in the elevation direction are established for the orientation towards the point 8 at step 80, and the receiving level at the point 8 is stored at step 84.

Upon completion of each of the foregoing procedures, one conical scan is established and the receiving levels at the points are stored in registers POR1 through POR8, respectively.

(8) The maximum receiving level is selected from ones at points 1 through 8 by checking the values in the registers POR1 through POR8 at steps 87 through 91.

(9) Then, at step 92, the attitude of the antenna Ant is determined by coinciding the the rotation center point of the beam with the resultant point at which the receiving level is maximum.

Figure 8A:
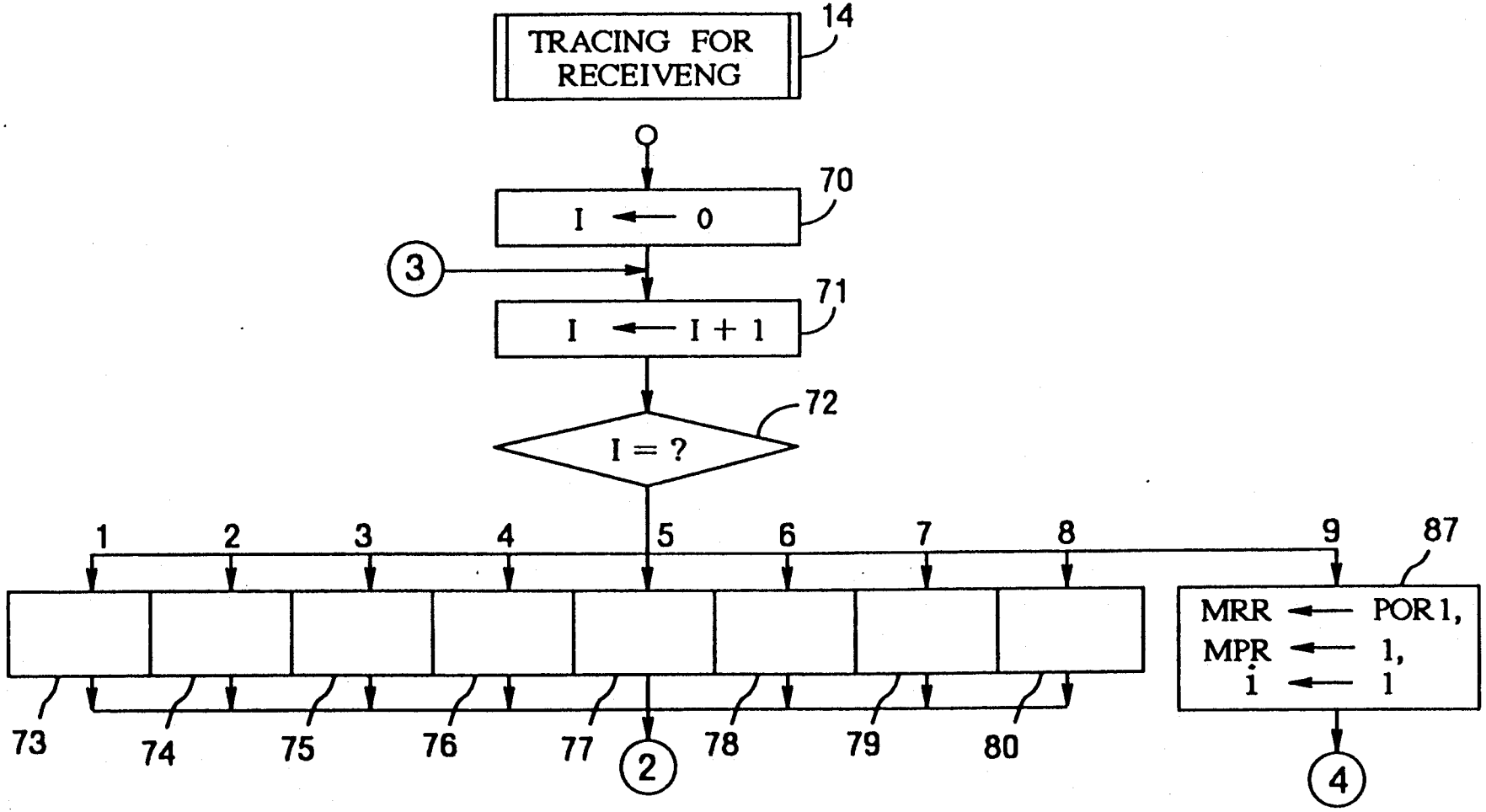
FIGS. 8*a*, 8*b* and 8*c* each of which shows a procedure of a subroutine for the tracking for receiving.
Figure 8B:
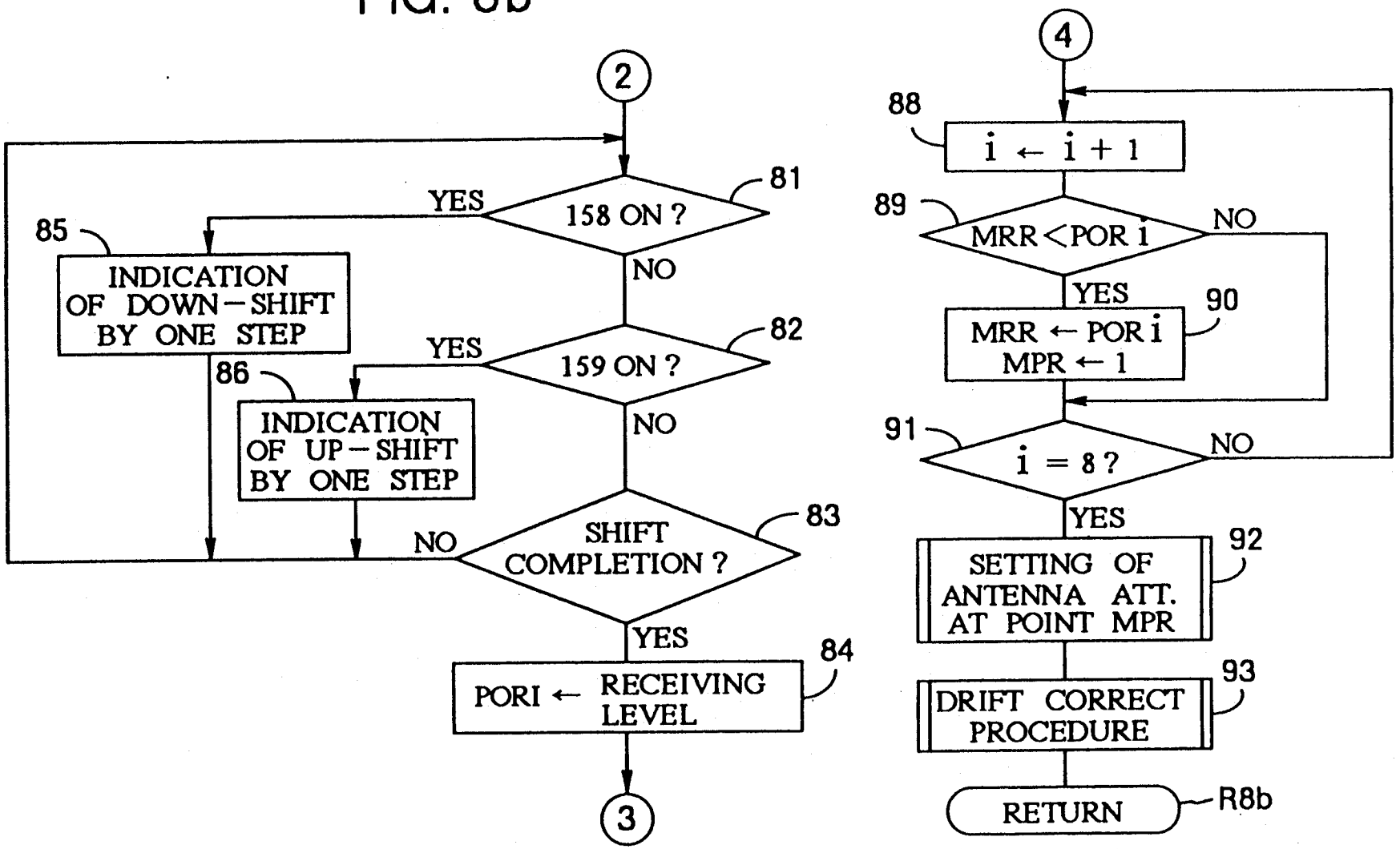

(10) "DRIFT CORRECTION PROCEDURE" is performed at step 93 which will be detailed later with reference to FIG. 8*a*.

In the case that the point "a" shown in FIG. 11 is the point at which the source of radio wave is located, at the point 1 the receiving level is maximum due to the formula as to the receiving level of point 1 >point 2>point 8>point 3>point 7>point 4>point 6>point 5. Thus, the attitude of the antenna Ant is changed or set by aiming the center portion thereof at the point 1.

As mentioned above, in "TRACING FOR RECEIVING" at step 14, one cycle conical scan within a minute range is established about the point which is the center point of the antenna Ant in order to set the attitude thereof in such a manner that the center shaft of the antenna beam is oriented to the point at which the receiving level is maximum. Therefore, in the case of the relative movement of the source of radio wave to the antenna Ant, the center axis of the antenna beam is moved for the following thereof on which the attitude control of the antenna Ant depends.

Figure 8C:
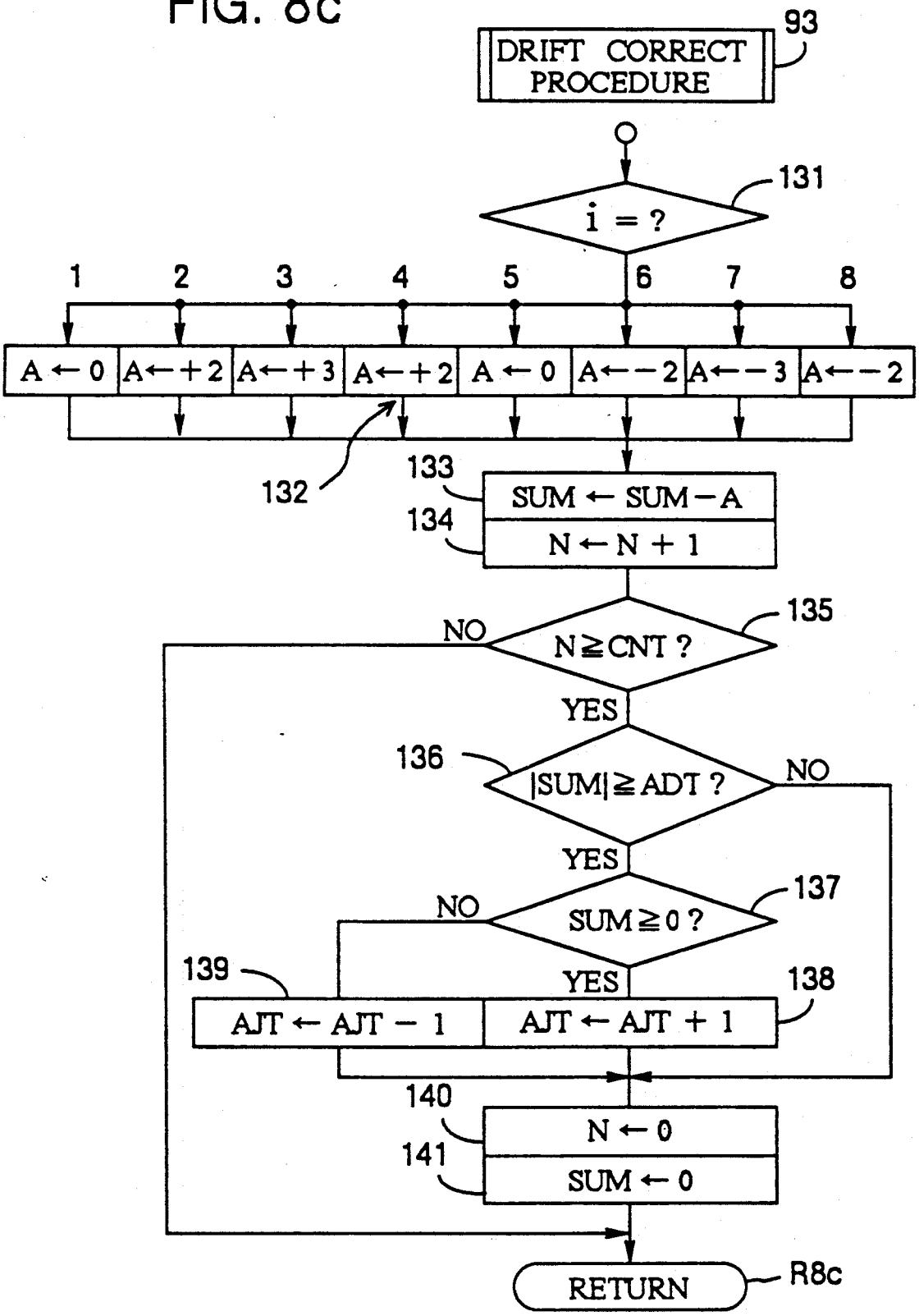

Next, "DRIFT CORRECTION PROCEDURE" at step 93 will be detailed with reference to FIG. 8*c*. It should be noted that since when the receiving level BSs is less than the value TH2 the "TRACING FOR SEARCHING" which will be detailed later is executed for setting the antenna Ant so that the receiving level BSs may become more than or equal to the value TH2 when the antenna Ant can receive radio wave, "TRACING FOR THE RECEIVING" at step 14 including "DRIFT CORRECTION PROCEDURE" at step 93 is executed at a cycle of T1 when the receiving level BSs is less than TH1 and is more than or equal to TH2.

In "DRIFT CORRECTION PROCEDURE", at step 131, a position of the most recently changed attitude of the antenna Ant or indicating the value of MPR at step 92 is referred at step 131, the position before the renewal of the antenna attitude corresponding to the point 0 in FIG. 11 is connected to each of the positions after the renewal of the antenna attitude corresponding to the points 0 through 8 for representing a vector and a data A is calculated which includes a component in the azimuth direction (the right direction and the left direction are set to be plus and minus, respectively) and the absolute length of the resultant vector at step 132. The value in the accumulator SUM is decreased with the data A and the resultant is stored in the accumulator SUM at step 133. The value in the resister N which indicates the number of the executions is added with 1 at step 134 and is checked at step 135 whether the value in the resister N becomes equal to the set value CNT or not. If so, it is checked wether the absolute value in the accumulator SUM is more than or equal to the reference value ADT at step 136 and in the case of positive result the sign of the value in the accumulator SUM is checked at step 137.

If the sign of the value in the accumulator SUM is plus which indicates the Offset in the leftward direction, the value in the resister AJT is increased by 1 at step 138 and the resultant value is also added to the value indicating the azimuth driving speed of the driver AZD 141 at step S6*b* in FIG. 5. Thus, if the azimuth driving speed is plus or in the direction of the rightward (minus or in the direction of the leftward), it is increased (decreased) by one unit.

If the sign of the value in the accumulator SUM is minus which indicates the offset in the rightward direction, the value in the resister AJT is decreased with one unit at step 139. Since the resultant value is added to the value indicating the azimuth driving speed of the motor 141 at step S6*b* in FIG. 5, if the azimuth driving speed is plus or in the direction of the rightward (minus or in the direction of the leftward), it is decreased (increased) by one unit. Thereafter, the resister N is cleared at step 140.

In summary of "DRIFT CORRECTION PROCEDURE" at step 93, every time the renewal of the attitude of the antenna Ant at steps 87 through 92 based on the conical scan at steps 70 through 80, component in the azimuth direction of the renewed vector (attitude change direction and magnitude) is accumulated in the accumulator SUM, and at each time of CNT time execution, the tendency of the attitude of the antenna Ant in the azimuth direction, and the drift adjusting value AJT of the value indicating the azimuth driving speed of the motor 141 to correct or cancel this tendency.

Even if the azimuth driving motor 141 is brought into movement at a low speed steadility due to thermal drift of the yaw angle speed detector 30 despite of no change in the attitude of the antenna Ant when the vehicle is rest, the resultant offset of the attitude of the antenna Ant is corrected by the conical scan and the renewal of the antenna attitude based thereon and the repetition of the conical scan and the renewal of the antenna attitude based thereon is established due to the foregoing steady movement of the motor 141 at a cycle. Thus, at each time of the completion of the repetition of CNT times, the speed of the motor 141 is decreased by one step, thereby decreasing the azimuth driving speed gradually. Then, the foregoing cycle is increased, the motor 141 stops in the long run which means the automatical correction of the errors by the thermal drift.

For example, when the accumulation of the errors as to the antenna attitude due to the late of the initiation or the termination of the change of the antenna attitude due to irregular steering movement of the vehicle, the direction along which the errors in the antenna attitude change is automatically checked or detected for correcting the driving speed of the motor 141 in the direction of the decrease of the error accumulation.

It is noted that the foregoing attitude control I is also executed during repetition executions of the attitude setting II due to the fact that steps 6*a*, 6*b* and 6*c* are executed just before the conical scan and the attitude setting II.

When the foregoing conical scan and the attitude setting II, the receiving level is not always more than or equal to TH1. If the receiving level becomes more than or equal to TH1 during the conical scan and the attitude setting II, only foregoing attitude control I is executed. When the conical scan and the attitude setting II fails to bring that the receiving level is not always more than or equal to TH1, the "TRACING SEARCH" will be executed at step 17.

Figure 9A:
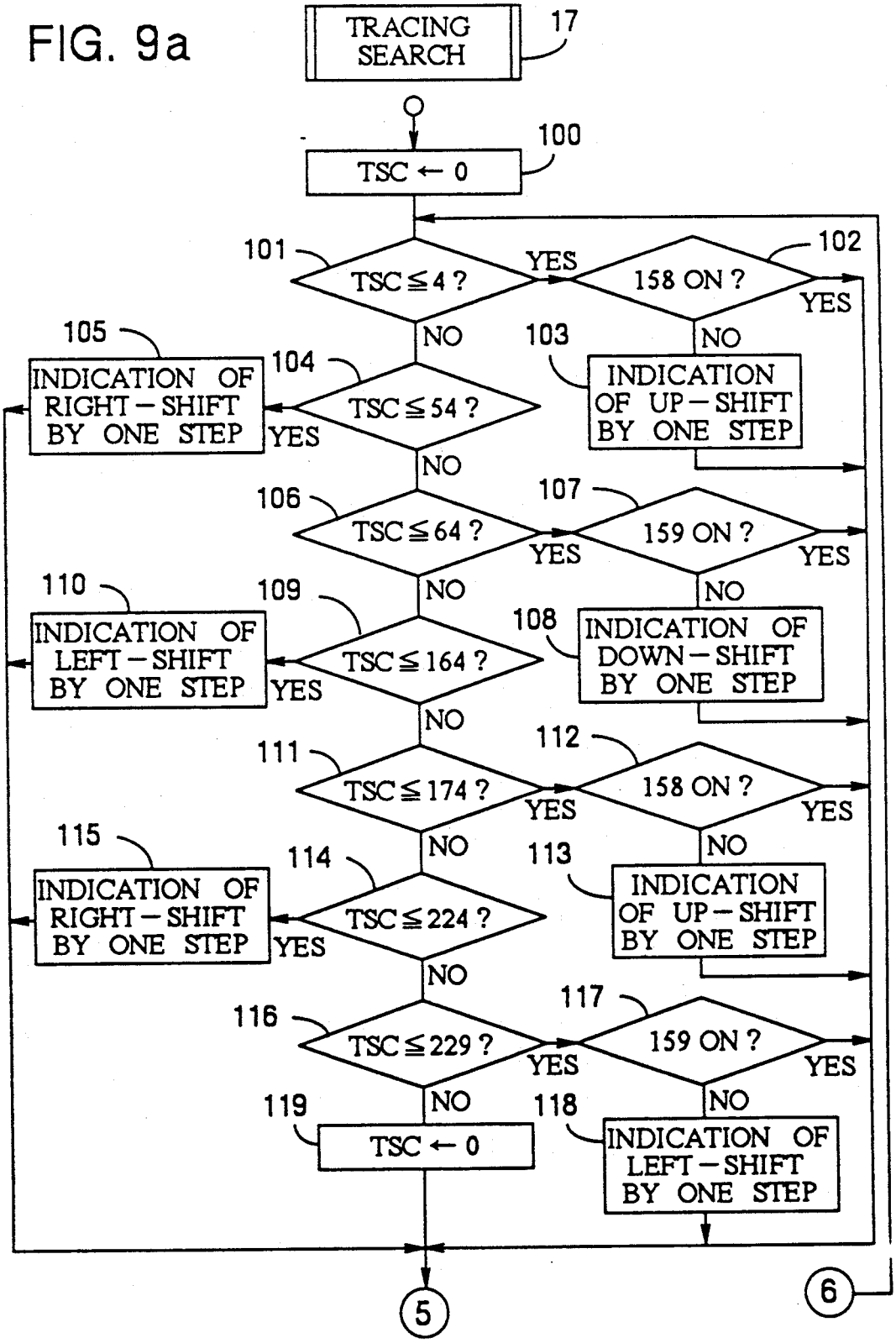
FIGS. 9*a* and 9*b* each of which shows a procedure of a subroutine the tracking for searching.
Figure 9B:
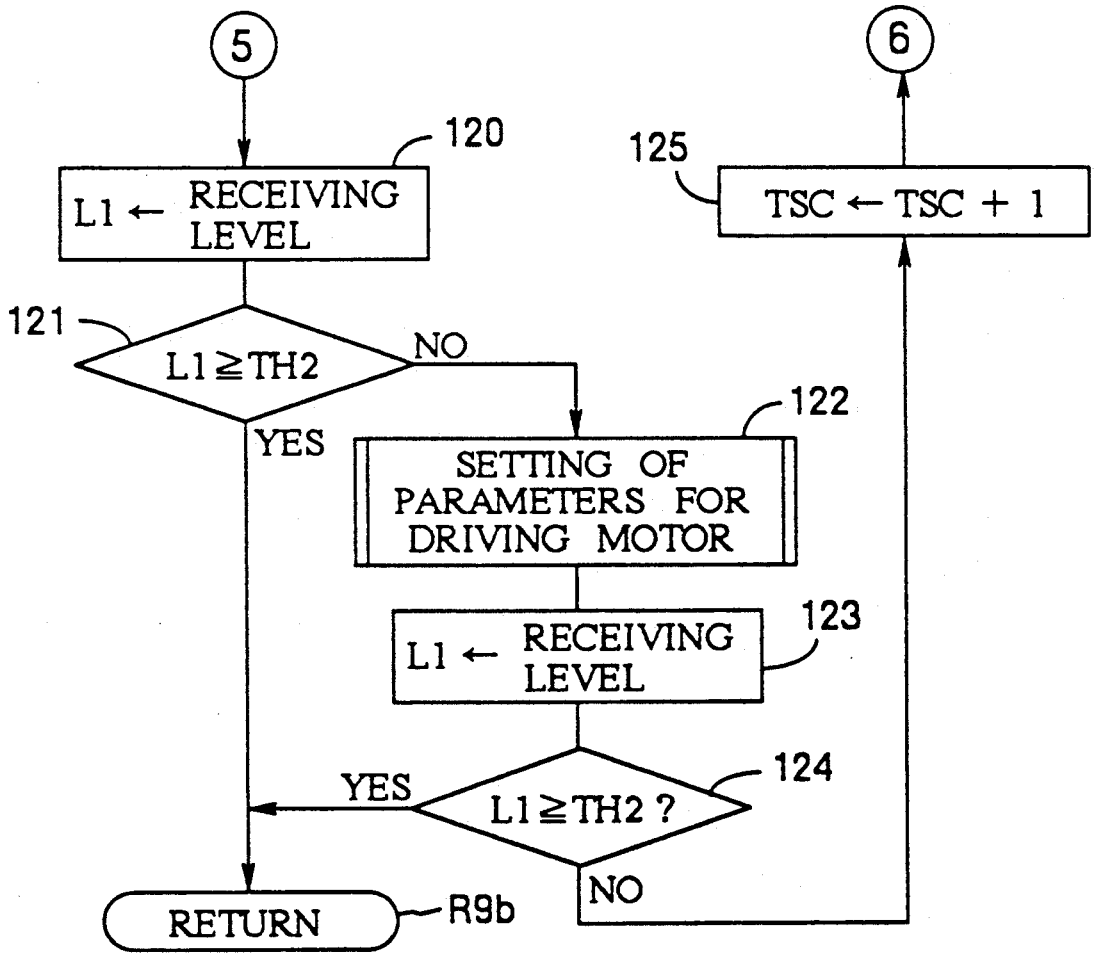
Figure 12:
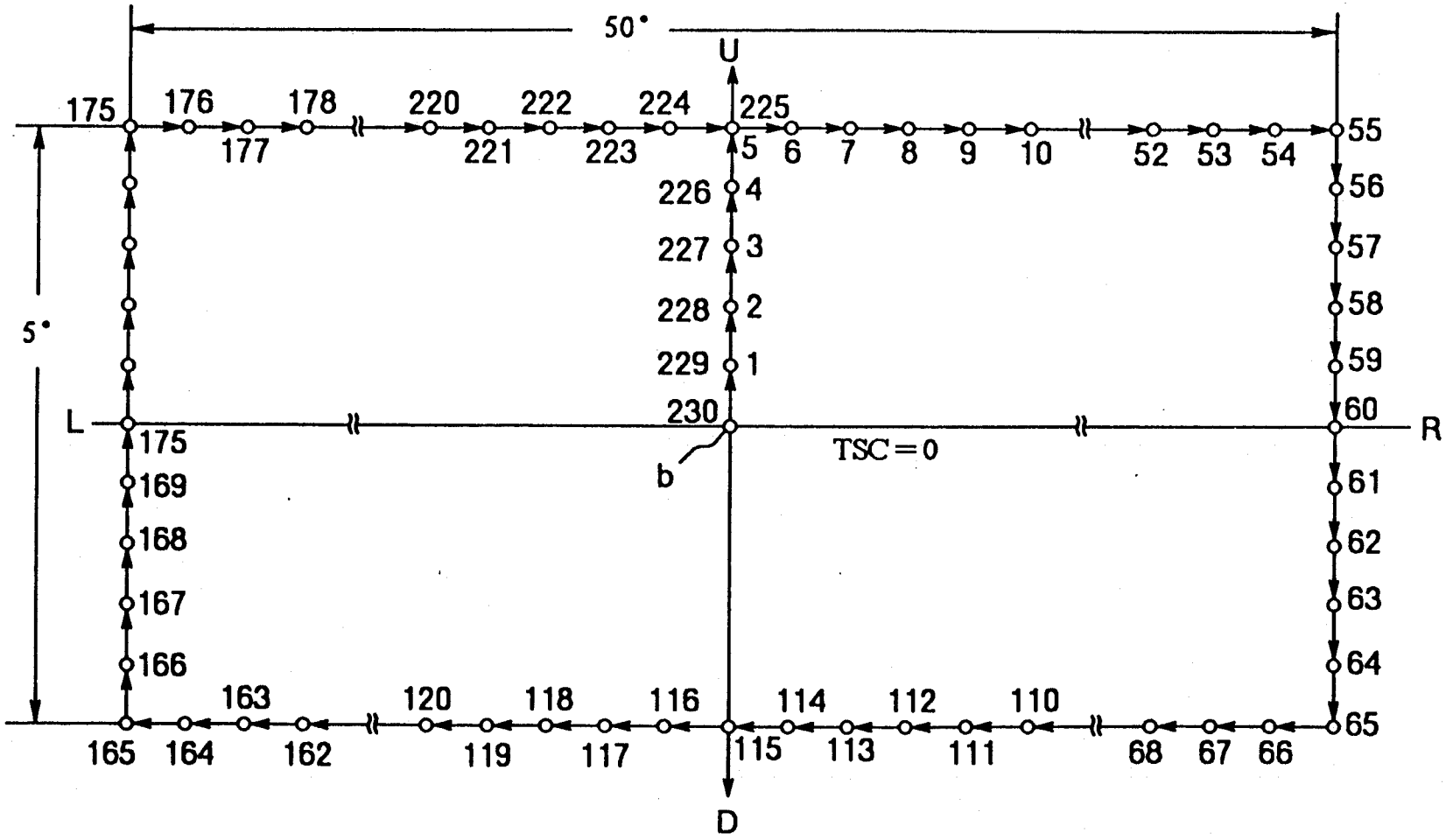
FIG. 12 is a graph showing the changing quantity of an antenna under tracking for searching.

III. FIGS. 9*a* and 9*b* show the contents of the "TRACING SEARCH" to be executed at step 17 and FIG. 12 shows the conceptual illustration thereof. At step 100, an initialization is established in such a manner that TSC=0 is set when the antenna Ant is oriented to a point "b" in FIG. 12.

(1) At step 101, it is checked wether TSC is less than or equal to 4 or not, and if so step 102 is executed for checking the condition of the switch 158. If the switch 158 is not in the closed condition, the motor driver ELD is ordered, at step 103, to establish an upward movement or shift by one step. This illustrates the scans from the point 0 through 5 in FIG. 12. In the case that TSC is more than 5 at step 101, the control proceeds to step 104.

(2) At step 104, TSC is checked to be less than or equal to 54 or not. So long as positive result, step 105 is performed for ordering one shift in the rightward direction to the driver AZD. This illustrates the scans from the point 5 through 55 in FIG. 12. In the case that TSC is more than 55 at step 104, the control proceeds to step 106.

(3) At step 106, TSC is checked to be less than or equal to 64 or not. So long as positive result, step 107 is performed for checking the condition of the switch 159. If the switch 159 is not in the closed condition, the motor driver ELD is ordered, at step 103, to establish a downward movement or shift by one step. This illustrates the scans from the point 55 through 65 in FIG. 12. In the case that TSC is more than 65 at step 106, the control proceeds to step 109.

(4) At step 109, TSC is checked to be less than or equal to 164 or not. So long as positive result, step 110 is performed for ordering one shift in the leftward direction to the driver AZD. This illustrates the scans from the point 65 through 165 in FIG. 12. In the case that TSC is more than 165 at step 104, the control proceeds to step 111.

(5) At step 111, TSC is checked to be less than or equal to 174 or not. So long as positive result, step 112 is performed for checking the condition of the switch 158. If the switch 158 is not in the closed condition, the motor driver ELD is ordered, at step 113, to establish an upward movement or shift by one step. This illustrates the scans from the point 155 through 175 in FIG.

12. In the case that TSC is more than 175 at step 111, the control proceeds to step 114.

(6) At step 114, TSC is checked to be less than or equal to 224 or not. So long as positive result, step 115 is performed for ordering one shift in the rightward direction to the driver AZD. This illustrates the scans from the point 175 through 225 in FIG. 12. In the case that TSC is more than 225 at step 114, the control proceeds to step 116.

(7) At step 116, TSC is checked to be less than or equal to 229 or not. So long as positive result, step 117 is performed for checking the condition of the switch 159. If the switch 159 is not in the closed condition, the motor driver ELD is ordered, at step 118, to establish a downward movement or shift by one step. This illustrates the scans from the point 225 through 230 in FIG. 12.

(8) When if TSC is more than or equal to 230 at step 116 or each of the shift operations is completed, step 120 is performed for reading the receiving level, the resultant is checked whether it is more than or equal to TH2, and if so the control is returned to the main routine (FIG. 5).

If the read receiving level is less than TH2, at step 123, the receiving level BSs is read again to be checked at step 124 whether it is more than or equal to TH2, and, if so, the control is returned to the main routine (FIG. 5). If the read receiving level is again less than TH2, the value TSC is added with 1 at step 125, and the control proceeds to step 101.

As a result of the processings at steps 101 through 125, until the receiving level BSs becomes more than or equal to the secondary set value TH2, the search is performed which establishing a locus from the point 0 through the point 230 identical thereto via points 1, 2, . . . and . . . 229 and at each of the point the receiving level is checked to be more than or equal to TH2 or not. When the receiving level remains at a value less than TH2 at the point 230 which is identical to the starting point 0 in effect, at step 119, TSC is reset to zero and similar search is initiated.

During such search, for changing the antenna attitude corresponding to the yaw angle speed Yas the setting of parameters for driving motor is established at step 122 which is the summation of steps 6*a*, 6*b* and 6*c* in function. Thus, the starting point 0 remains unchanged so long as the vehicle per se remains unchanged in its motion or attitude. Though the automatical shift of the starting point is established due to the attitude change of the vehicle, the range to be searched (FIG. 12) relative to the starting point remains unchanged.

In the case of the interruption of the radio wave by an obstacle, the repetition of the foregoing "SEARCH SCAN" at step 17 is performed and during this repetition if the vehicle changes its attitude the starting point of the search scan is also shifted. Thus, if radio wave is interrupted, the search scan which illustrates the locus shown in FIG. 12 is repeated on the basis of the most recently established beam central axis of the antenna Ant, which is set to be shifted upon the attitude change of the vehicle.

In summary, (I) While the receiving level BSs is being more than or equal to TH1, the attitude of the antenna Ant is set to be changed depending on the yaw angle speed Yas of the vehicle or its attitude change.

(II) When the receiving level BSs is less than TH1 and is more than or equal to TH2, in addition to the antenna attitude change in the above item (I), the conical scan and subsequent antenna attitude change for establishing the orientation of the antenna Ant to suitable direction. At each time both are performed, the component in the azimuth direction of the vector of the attitude change is accumulated and every time executions are established CNT times, the accumulated value indicating the offset magnitude in the azimuth direction is set to be cancelled by the correct data AJT in the drift correction resister AJTR which is also used for regulating the driving speed of the azimuth driving motor 141.

(III) When the receiving level BSs is less than TH2, in addition to the antenna attitude change in the above item (I), "TRACING SEARCH" as shown in FIG. 12 is established in a range which is wider that that of the foregoing conical scan.

As apparent from the foregoing embodiment of the present invention, it can be easily understood that the present invention can be applied to a mobile body other than a vehicle such as a ship, a train or an airplane and is applicable in relation to the pitch angle and the elevation attitude control. In addition, other parameter such as pitch angle speed, rolling angle speed or elevation angle speed can be used in addition to yaw angle speed.

While the invention has been particularly shown and described with reference to preferred embodiment thereof, it will be understood that by those in the art that the foregoing and other changes in form and details may be made therein without departing from the spirit and scope of the invention.

What is claimed is:

1. An attitude control system for an antenna (Ant) which is mounted on a movable body to be oriented to a source of a radio wave, the system comprising:

supporting means for supporting the antenna in such a manner that the antenna is rotatable relative to the movable body;

driving means for rotating the antenna;

attitude change detecting means for detecting a yaw angle speed of the movable body relative to the source of the radio wave;

first control means for controlling the driving means in such a manner that the antenna is driven at a speed corresponding to the sum of the yaw angle speed and a set correction value so as to correct the shift of the antenna which is due to the attitude change of the movable body relative to the source of the radio wave;

receiving means, connected to the antenna, for receiving radio waves;

second control means for controlling the driving means in such a manner that the attitude of the antenna is changed in order to seek its optimum position at which the maximum value of the receiving signal level is obtained;

accumulating means, connected to the second control means, for the vector accumulation upon the changing of the attitude of the antenna by the second control means; and drift correcting means, connected to the first control means and the accumulating means, for renewing the correcting value in order that the accumulated vector becomes zero.

2. An attitude control system for an antenna on a mobile body according to claim 1, wherein the attitude change detecting means is a yaw angle speed detector.

3. An attitude control system for an antenna on a mobile body according to claim 1, wherein the first control means, the second control means and the drift correcting means are integrated in a common microcomputer.

4. An attitude control system for an antenna on a mobile body according to claim 6, wherein the yaw angle speed detector is a gyro.

* * * * *